US006574999B2

(12) United States Patent
Chen

(10) Patent No.: US 6,574,999 B2
(45) Date of Patent: Jun. 10, 2003

(54) PADLOCK WITH A U-SHAPED LOCK CASING

(76) Inventor: Waterson Chen, 8F, No. 428, Wu-Chuan S. Rd., Taichung City (TW)

( * ) Notice: Subject to any disclaimer, the term of this patent is extended or adjusted under 35 U.S.C. 154(b) by 0 days.

(21) Appl. No.: 10/007,828

(22) Filed: Dec. 3, 2001

(65) Prior Publication Data

US 2002/0046583 A1 Apr. 25, 2002

Related U.S. Application Data

(63) Continuation-in-part of application No. 09/576,661, filed on May 23, 2000.

(51) Int. Cl.[7] ..... E05B 67/36

(52) U.S. Cl. ..... 70/33; 70/226; 70/34

(58) Field of Search ..... 70/32–34, 233, 70/225, 226

(56) References Cited

U.S. PATENT DOCUMENTS

| | | | | |
|---|---|---|---|---|
| 627,238 | A | 6/1899 | Peterson | 70/423 |
| 1,195,808 | A | 8/1916 | Grgich | 70/423 |
| 2,104,981 | A | 1/1938 | Falk | 70/33 |
| 2,656,704 | A | 10/1953 | Mancuso | 70/32 X |
| 2,930,219 | A | 3/1960 | Fansmith | 70/428 |
| 2,999,377 | A | 9/1961 | Raye | 70/32 |
| 3,714,804 | A | 2/1973 | French | 70/419 |
| 3,858,419 | A | 1/1975 | Hampton | 70/55 |
| 4,222,253 | A | 9/1980 | Peitsmeier | 70/417 |
| 4,286,445 | A | 9/1981 | Sills | 70/55 |
| 4,404,825 | A | 9/1983 | Dixon et al. | 70/368 |
| 4,869,082 | A | 9/1989 | Appelbaum | 70/63 |
| 4,881,391 | A | 11/1989 | Villa et al. | 70/455 |
| 4,953,371 | A | 9/1990 | Appelbaum | 70/32 |
| 5,365,758 | A | 11/1994 | Shieh | 70/33 |
| 5,442,941 | A | 8/1995 | Kahonen et al. | 70/34 |
| 5,517,837 | A | 5/1996 | Wang | 70/226 |
| 5,544,506 | A | 8/1996 | Nakano | 70/34 |
| 5,964,107 | A | * 10/1999 | Chang | 70/33 |
| 5,979,200 | A | 11/1999 | Cliff | 70/491 |
| 5,987,939 | A | 11/1999 | Pitisettakarn | 70/33 |

FOREIGN PATENT DOCUMENTS

| | | |
|---|---|---|
| CH | 472564 | 6/1969 |
| DE | 2 810 756 | 9/1978 |
| IT | 411689 | 3/1945 |
| IT | 412692 | 2/1946 |
| IT | 417571 | 1/1947 |
| IT | 455873 | 3/1950 |

* cited by examiner

*Primary Examiner*—Suzanne Dino Barrett
(74) *Attorney, Agent, or Firm*—Merchant & Gould P.C.

(57) ABSTRACT

A padlock includes a U-shaped lock casing having intercommunicated core receiving space and latch recess, aligned first and second shackle insert holes, and a slide channel communicating the second shackle insert hole with the latch recess. A lock core unit is received in the core receiving space, and includes a latch member extending into the latch recess and rotatable inside the latch recess between locking and unlocking positions. The latch member has an end face formed with a pin hole eccentric to an axis of the lock core unit. A shackle bar extends into the first and second shackle insert holes. A catch member is disposed slidably in the latch recess, and is formed with a pin extending rotatably into the pin hole in the latch member for engaging the latch member.

7 Claims, 5 Drawing Sheets

PADLOCK WITH A U-SHAPED LOCK CASING

CROSS-REFERENCE TO RELATED APPLICATION

This application is a continuation-in-part (CIP) of U.S. patent application Ser. No. 09/576,661, filed on May 23, 2000, the entire disclosure of which is incorporated herein by reference.

BACKGROUND OF THE INVENTION

1. Field of the Invention

The invention relates to a padlock with a U-shaped lock casing, more particularly to a padlock which can minimize malfunctioning thereof due to spring fatigue.

2. Description of the Related Art

A conventional padlock includes a lock casing, a key-operated lock core unit mounted in the lock casing, a shackle bar inserted between opposite shackle mounting portions of the lock casing for retaining an object on the lock casing between the opposite shackle mounting portions, and spring-loaded tumbler means associated operably with the lock core unit for engaging removably the shackle bar. The conventional padlock generally suffers from a disadvantage in that the lock core unit is not removable from the lock casing. As such, in case of spring fatigue that leads to malfunctioning of the padlock, the entire padlock has to be discarded although the lock core unit is still operable.

In Applicant's co-pending U.S. patent application Ser. No. 09/576,661, there is disclosed a padlock which includes a lock casing having a core receiving space, a latch recess communicated with the core receiving space, a first shackle insert hole, a second shackle insert hole aligned with the first shackle insert hole, and a slide channel communicating the second shackle insert hole with the latch recess. A lock core unit includes a latch member extending into the latch recess and rotatable inside the latch recess between locking and unlocking positions. A shackle bar extends into the first and second shackle insert holes. A catch member is disposed slidably in the latch recess, and has a first abutment wall formed with a shackle engaging projection that extends into the slide channel, a second abutment wall spaced apart from the first abutment wall, and a latch cavity defined between the first and second abutment walls for extension of the latch member thereinto. The latch member pushes the first abutment wall to enable the shackle engaging projection to project into the second shackle insert hole and engage the shackle bar when the latch member is disposed in the locking position. The latch member pushes the second abutment wall to enable the shackle engaging portion to retract into the slide channel and disengage from the shackle bar when the latch member is disposed in the unlocking position.

As shown in FIGS. 2 and 3 of the aforementioned co-pending Patent application, the latch member has a latch base formed with a slide passage, a latch body mounted inside the slide passage, and a biasing spring provided in the slide passage for biasing the latch body to extend outwardly of the slide passage and to project from the latch base. In case the biasing spring experiences spring fatigue under a locking state of the padlock, the lock core unit cannot be operated for retracting the latch body and rotating the latch member to the unlocking position. As a result, the padlock does not work and might need to be destroyed for removal from the object locked thereon.

SUMMARY OF THE INVENTION

Therefore, the object of the present invention is to provide a padlock which can effectively minimize malfunctioning thereof due to spring fatigue.

Accordingly, the padlock of the present invention includes a lock casing, a key-operated lock core unit, a shackle bar, and a catch member. The lock casing has first and second end surfaces which are opposite to each other in a longitudinal direction, and includes a lock core mounting portion adjacent to the first end surface, a latch receiving portion adjacent to the second end surface, and first and second shackle mounting portions. The lock core mounting portion is formed with a core receiving space that extends in the longitudinal direction from the first end surface toward the second end surface. The latch receiving portion is formed with a latch recess communicated with the core receiving space. The first shackle mounting portion extends from the lock core mounting portion in a first transverse direction transverse to the longitudinal direction, and is formed with a first shackle insert hole. The second shackle mounting portion extends from the latch receiving portion in the first transverse direction, and is opposite to the first shackle mounting portion. The second shackle mounting portion is formed with a second shackle insert hole that is aligned with the first shackle insert hole in the longitudinal direction. The second shackle mounting portion is further formed with a slide channel that extends in the first transverse direction to communicate the second shackle insert hole with the latch recess. The lock core unit includes a cylindrical lock core formed with a keyhole and disposed in the core receiving space. The lock core is adapted to be rotated inside the core receiving space upon insertion of a corresponding key into the keyhole. The lock core has one end disposed adjacent to the latch recess. The lock core unit further includes a latch member connected to said one end of the lock core and extending into the latch recess. The latch member is rotatable inside the latch recess between locking and unlocking positions when the corresponding key is operated. The latch member has an end face which is transverse to an axis of the lock core and which is formed with a pin hole that is eccentric to the axis of the lock core. The shackle bar has a first end extending into the first shackle insert hole, and a second end extending into the second shackle insert hole. At least one of the first and second ends is removable from a corresponding one of the first and second shackle insert holes. The catch member is disposed slidably in the latch recess, and has a shackle engaging end portion for engaging the shackle bar, and a latch engaging end portion opposite to the shackle engaging end portion and formed with a pin that extends rotatably into the pin hole in the latch member for engaging the latch member such that the catch member is movable between locking and unlocking positions when the latch member moves between the locking and unlocking positions. The shackle engaging end portion of the catch member extends into the second shackle insert hole via the slide channel for engaging the shackle bar when the catch member is moved to the locking position. The shackle engaging end portion is retracted into the slide channel for disengaging from the shackle bar when the catch member is moved to the unlocking position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 2:
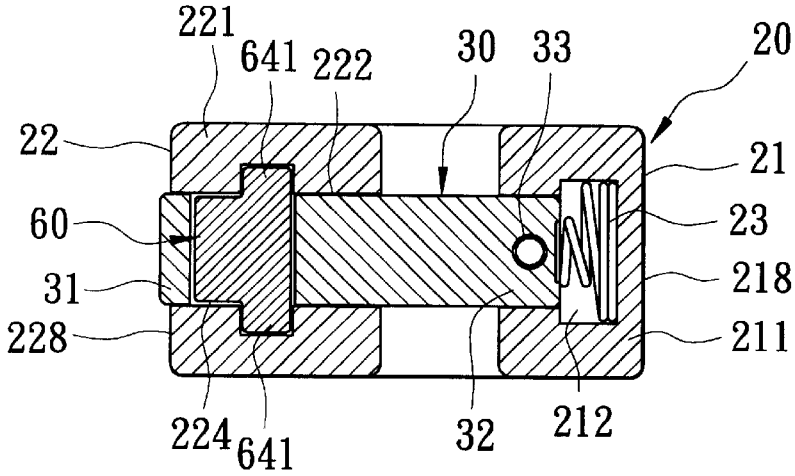
FIG. 2 is a cross-sectional top view of FIG. 1.
Figure 1:
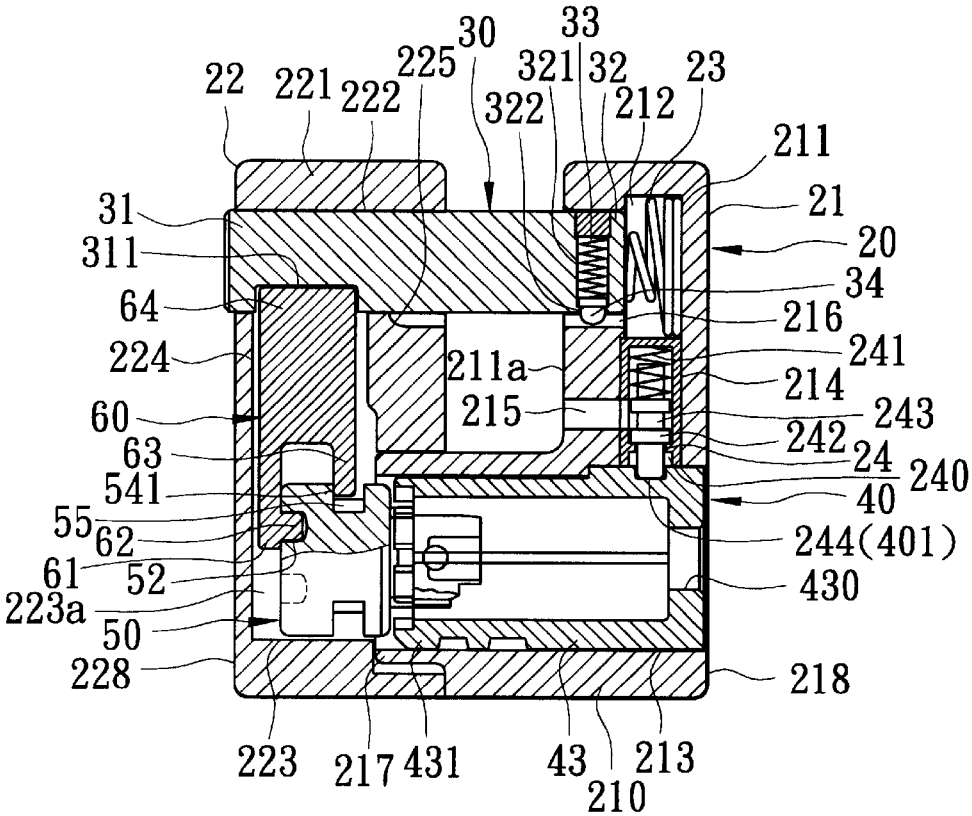
FIG. 1 is a cross-sectional view of a preferred embodiment of the padlock of the present invention in a locking state.

Referring to FIGS. 1 and 2, the preferred embodiment of the padlock of the present invention is shown to include a U-shaped lock casing 20, a key-operated lock core unit 40, a shackle bar 30, and a catch member 60.

The lock casing 20 includes a first casing part 21 and a second casing part 22 secured to the first casing part 21. The first casing part 21 has a first end surface 218, a lock core mounting portion 210 extending from the first end surface 218 in a longitudinal direction, and a first shackle mounting portion 211 extending from the lock core mounting portion 210 in a first transverse direction transverse to the longitudinal direction. The lock core mounting portion 210 has an insert end 217 opposite to the first end surface 218. The lock core mounting portion 210 is formed with a core receiving space 213 that extends in the longitudinal direction from the first end surface 218 through the insert end 217. The first shackle mounting portion 211 is formed with a first shackle insert hole 212 which is provided with a biasing spring that is in the form of a compression spring 23.

The second casing part 22 has a second end surface 228 which is opposite to the first end surface 218 of the first casing part 21 in the longitudinal direction, a latch receiving portion 223 adjacent to the second end surface 228, and a second shackle mounting portion 221 that extends from the latch receiving portion 223 in the first transverse direction. The latch receiving portion 223 is formed with a latch recess 223*a* which is communicated with the core receiving space 213. The latch receiving portion 223 is welded to the insert end 217 of the lock core mounting portion 210 of the first casing part 21. The second shackle mounting portion 221 is opposite to and is spaced-apart from the first shackle mounting portion 211 in the longitudinal direction, and has a second shackle insert hole 222 formed therethrough. The second shackle insert hole 222 extends in the longitudinal direction, and is aligned with the first shackle insert hole 212. The second shackle insert hole 222 has an inner surface formed with a retaining shoulder 225 that confronts the first shackle mounting portion 211. The second casing part 22 is further formed with a slide channel 224 that extends in the first transverse direction to communicate the second shackle insert hole 222 with the latch recess 223*a*.

The lock core unit 40 includes a cylindrical lock core 43 formed with a keyhole 430 and disposed in the core receiving space 213. The lock core 43 is adapted to be rotated inside the core receiving space 213 in a known manner upon insertion of a corresponding key (not shown) into the keyhole 430. The lock core 43 has one end 431 disposed adjacent to the insert end 217 of the lock core mounting portion 210. The lock core unit 40 further includes a latch member 50 connected to the end 431 of the lock core 43 and extending out of the core receiving space 213. The latch member 50 extends into the latch recess 223*a*, and is rotatable inside the latch recess 223*a* between locking and unlocking positions when the corresponding key is operated.

The shackle bar 30 is an elongated straight bar, and has a first end 32 which extends removably into the first shackle insert hole 212 and which is formed with a ball chamber 321. The ball chamber 321 is installed with a spring-loaded ball unit which includes a spring 33 and a ball member 34 mounted on a distal end of the spring 33. The spring 33 biases the ball member 34 to extend out of the ball chamber 321 and to project from the shackle bar 30 in a direction transverse to the length of the shackle bar 30. The ball chamber 321 has a slightly converging opening 322 for retaining the ball member 34 thereat. The first shackle insert hole 212 has an inner surface formed with a slide groove 216 which extends along the longitudinal direction to permit sliding movement of the ball member 34 therealong when the first end 32 of the shackle bar 30 extends into and is removed from the first shackle insert hole 212. The shackle bar 30 further has a second end 31 which extends through the second shackle insert hole 222 and which is formed with a shackle groove 311. The second shackle insert hole 222 has an inner surface formed with a retaining shoulder 225 confronting the first shackle mounting portion 211 and registered with the slide groove 216.

Figure 3:
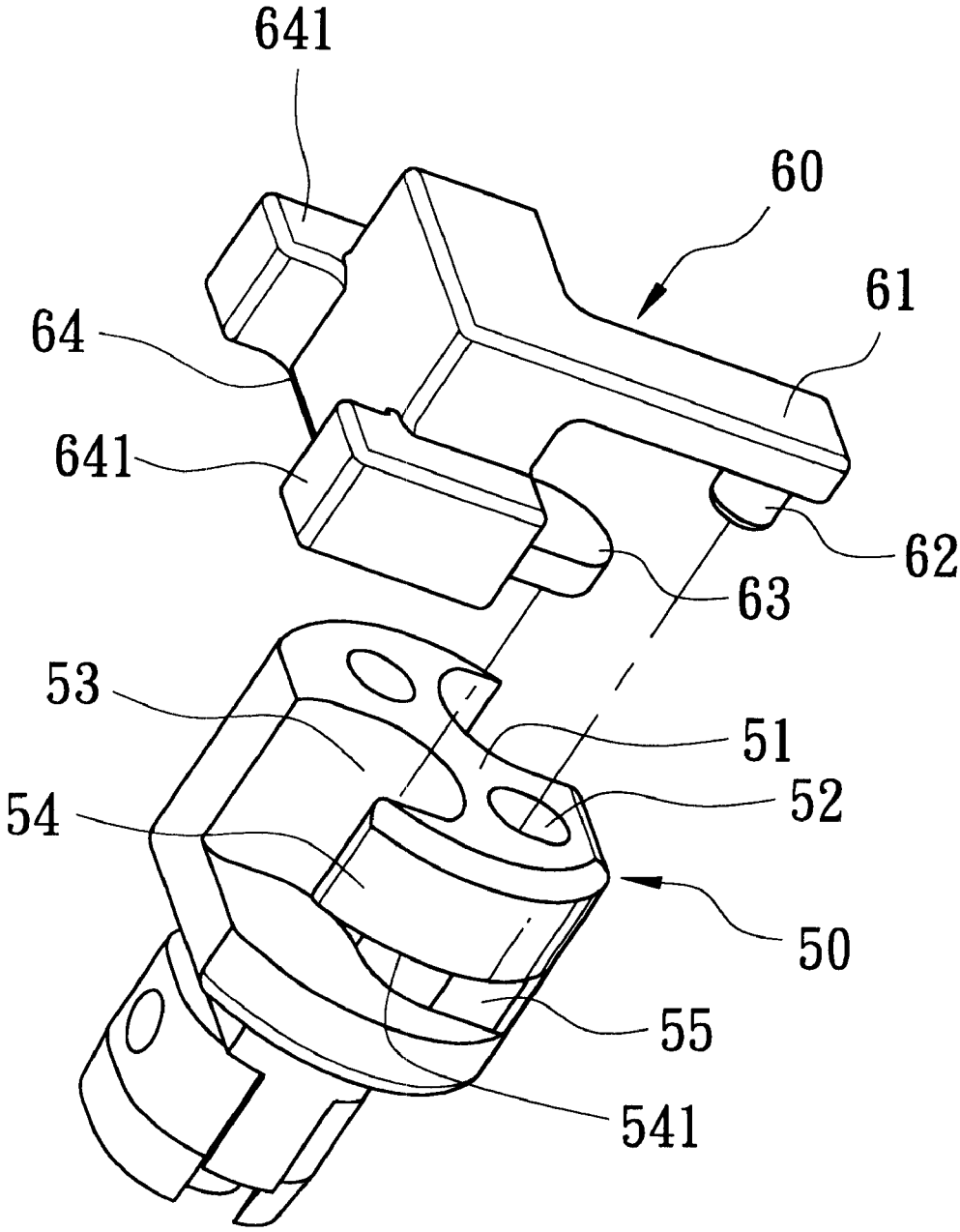
FIG. 3 is an exploded perspective view illustrating the engagement between a catch member and a latch member of the padlock of the preferred embodiment.
Figure 6:
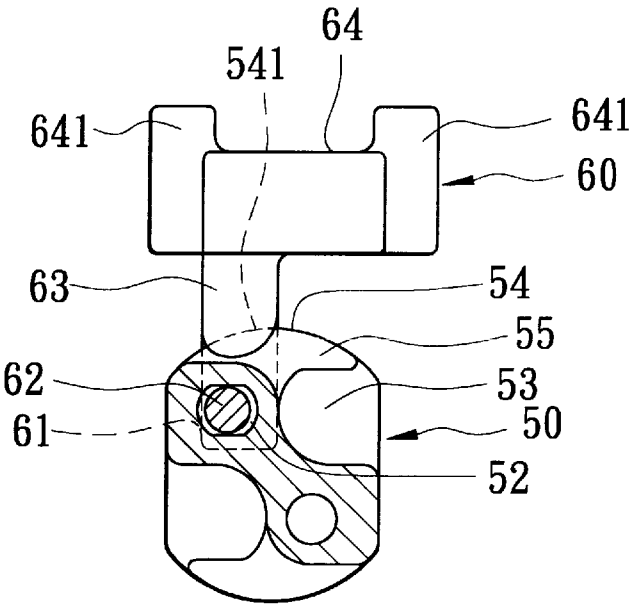
FIG. 6 is a partly sectioned schematic view illustrating relative positions of the latch member and the catch member when the latch member is in a locking position.

With further reference to FIG. 3, the latch member 50 has a distal end face 51 transverse to an axis of the lock core unit 40, and a side wall 54 transverse to the distal end face 51. The distal end face 51 is formed with a pin hole 52 that is eccentric to the axis of the lock core unit 40. The side wall 54 is formed with a slide slot 55 that extends along a plane parallel to the end face 51, and a communicating hole 53 that extends parallel to the axis of the lock core unit 40 from the end face 51 to the slide slot 55. The side wall 54 is formed with a curved stop flange 541 between the slide slot 55 and the end face 51. The catch member 60 is disposed in the latch recess 223*a*, and is slidable between the slide channel 224 and the latch recess 223*a*. The catch member 60 has a shackle engaging end portion 64 extending into the slide channel 224, and a latch engaging end portion 61 opposite to the shackle engaging end portion 64 and formed with a cylindrical pin 62 that extends rotatably into the pin hole 52 for engaging the latch member 50. The shackle engaging end portion 64 is formed with two opposite slide blocks 641 on two opposite side walls thereof. The slide blocks 641 are slidable smoothly and stably along the slide channel 224. The catch member 60 is further formed with a stop projection 63 which extends from the shackle engaging end portion 64 toward the latch engaging end portion 61 and which extends into and which is slidable along the slide slot 55. When the lock core unit 40 is operated by the corresponding key (not shown) to rotate the latch member 50 for moving the same to the locking position, the catch member 60 is pushed away from the latch member 50, as shown in FIG. 6, and toward the second shackle insert hole 222 for moving to a locking position, wherein the shackle engaging end portion 64 projects into the second shackle insert hole 222 for engaging the shackle groove 311 in the second end 31 of the shackle bar 30, as shown in FIG. 1. On the other hand, when the latch member 50 is moved to an unlocking position by operating the key, the catch member 60 is pulled toward the latch member 50, as shown in FIG. 5, for moving to an unlocking position, wherein the shackle engaging end portion 64 is retracted into the slide channel 224 for disengaging from the shackle bar 30, as shown in FIG. 4.

Referring back to FIG. 1, the first shackle mounting portion 211 has a passage 214 which is formed between the core receiving space 213 and the first shackle insert hole 212 and which has a mounting sleeve 24 received fittingly and fixedly therein. The mounting sleeve 24 confines a receiving cavity 240 communicated with the lock receiving space 213. The receiving cavity 240 is installed with a lock core retainer which includes a retaining shaft 242 and a biasing spring that is in the form of a compression spring 241. The retaining shaft 242 extends in the first transverse direction, and has an engaging end 244 proximate to the core receiving space 213. The compression spring 241 is disposed around the retaining shaft 242 and applies a biasing force to the retaining shaft 242 so as to enable the engaging end 244 of the retaining shaft 242 to project into the lock receiving space 213 for engaging a retaining groove 401 formed in an outer wall surface of the lock core unit 40 in order to retain the lock core unit 40 in the lock core mounting portion 210. The retaining shaft 242 has an outer surface formed with a groove 243. The first shackle mounting portion 211 has a side wall 211*a* confronting the second shackle mounting portion 221 and formed with a through hole 215 that is communicated with the receiving cavity 240 inside the mounting sleeve 24.

Referring to FIGS. 1 and 6, when the latch member 50 is disposed in the locking position, the stop projection 63 of the catch member 60 abuts against the stop flange 541 of the latch member 50 to prevent disengagement of the latch member 50 from the catch member 60 in a direction along the axis of the lock core unit 40, thereby strengthening the engagement between the latch member 50 and the catch member 60. At this time, the through hole 215 may be blocked by an object (not shown) that is locked on the shackle bar 30 of the padlock.

Figure 4:
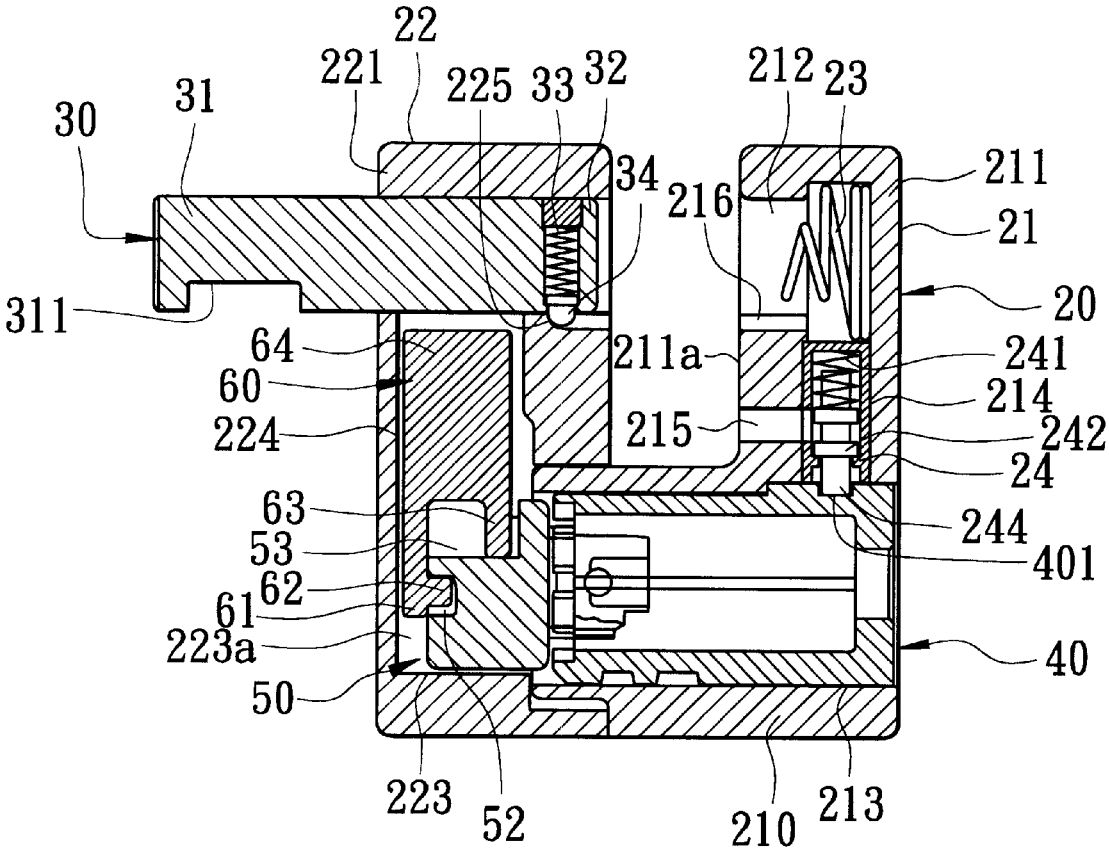
FIG. 4 is a cross-sectional view of the preferred embodiment in an unlocking state.
Figure 5:
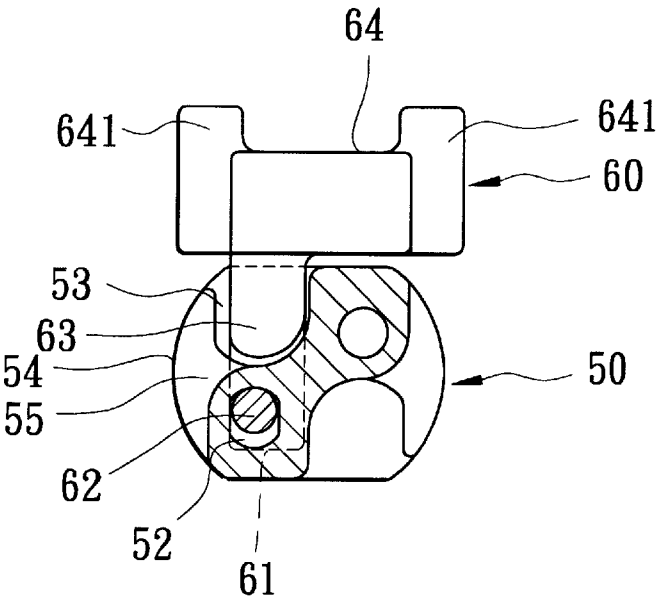
FIG. 5 is a partly sectioned schematic view illustrating relative positions of the latch member and the catch member when the latch member is in an unlocking position.

Referring to FIG. 4, when the latch member 50 moves to the unlocking position, the shackle bar 30 springs away from the first shackle insert hole 212 by virtue of the compression spring 23 provided in the first shackle insert hole 212. The ball member 34 slides along the slide groove 216 and then abuts against the retaining shoulder 225 so as to prevent removal of the shackle bar 30 from the second shackle insert hole 222. The spring-loaded ball unit, including the ball member 34 and the spring 33, thus constitute an abutment unit for abutting against the retaining shoulder 225 so as to prevent removal of the shackle bar 30 from the second shackle mounting portion 33, and thus from the lock casing 20, when the shackle bar 30 springs away from the first shackle mounting portion 211.

Figure 7:
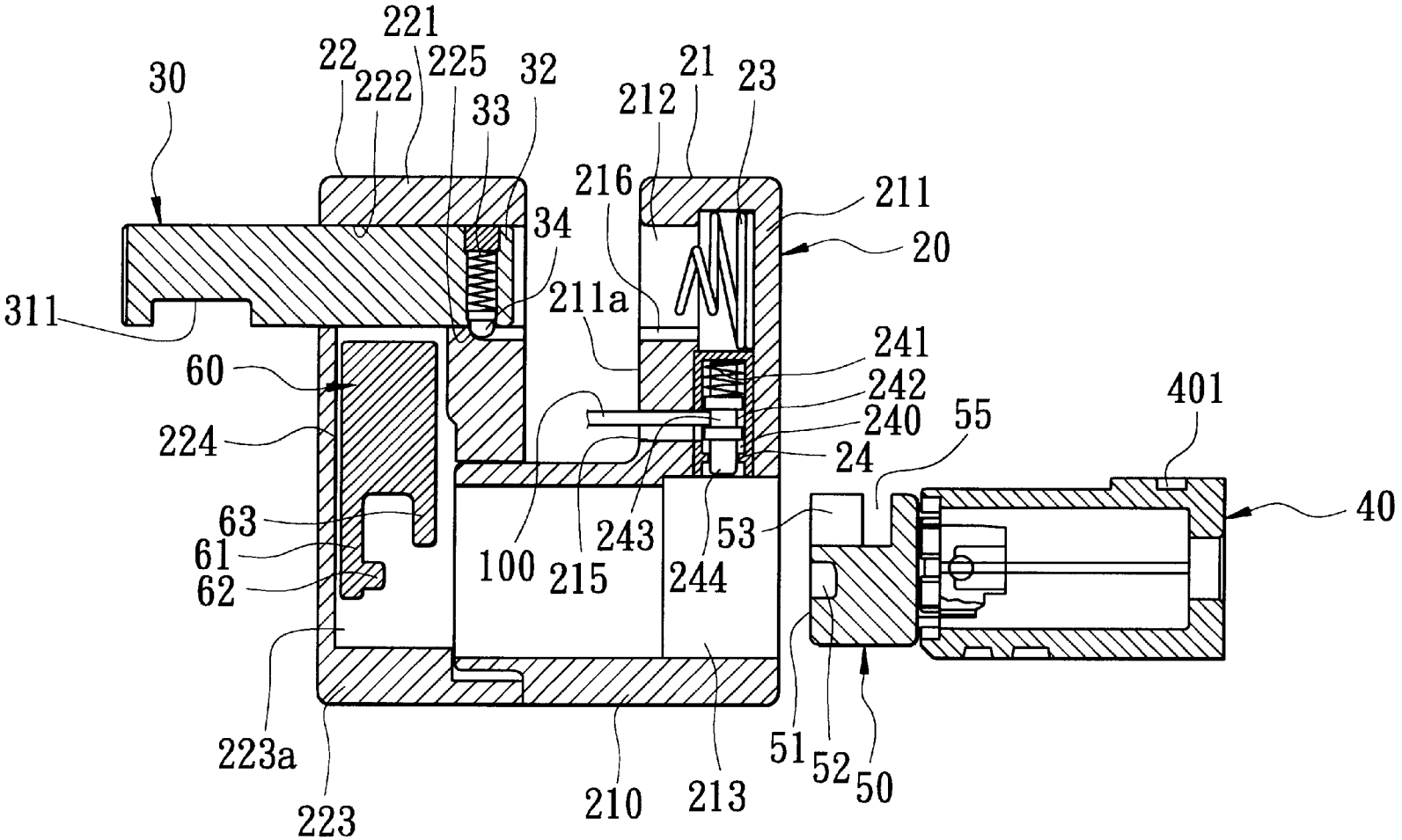
FIG. 7 is a cross-sectional view illustrating how a lock retainer is operated to permit removal of a lock core unit of the padlock.

Under this state, with further reference to FIG. 5, the stop projection 63 of the catch member 60 is registered with the communicating hole 53 in the latch member 50 to permit removal of the latch member 50 from the catch member 60 in the direction along the axis of the lock core unit 40. When it is desired to remove the lock core unit 40 for replacement purposes, the latch member 50 is first moved to the unlocking position and the object that is locked on the padlock is subsequently removed. Then, as shown in FIG. 7, a tool 100 is extended into the clearance between the first and second shackle mounting portions 211, 221, and into the receiving cavity 240 via the through hole 215 for engaging the groove 243 of the retaining shaft 242. By moving the retaining shaft 242 in a direction away from the core receiving space 213 to compress the spring 241, the engaging end 244 of the retaining shaft 242 can be retracted into the receiving cavity 240, thereby disengaging the retaining shaft 242 from the lock core unit 40. The lock core unit 40 can be removed from the core receiving space 213 at this time.

Without the use of a spring inside the latch member 50, movement of the catch member 60 between the locking and unlocking positions is a direct result of the rotation of the latch member 50 by virtue of the engagement between the pin 62 and the pin hole 52. In case any of the springs 23, 33, 241 experiences spring fatigue, the padlock is still operable to perform its locking and unlocking functions. By simply replacing the springs 23, 33, 241 with new ones, the padlock 1 can be used again. The service life of the padlock 1 is thus lengthened.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A padlock comprising:

a lock casing having first and second end surfaces which are opposite to each other in a longitudinal direction, and including a lock core mounting portion adjacent to said first end surface and formed with a core receiving space that extends in the longitudinal direction from said first end surface toward said second end surface, a latch receiving portion adjacent to said second end surface and formed with a latch recess communicated with said core receiving space, a first shackle mounting portion that extends from said lock core mounting portion in a first transverse direction to the longitudinal direction and that is formed with a first shackle insert hole, and a second shackle mounting portion that extends from said latch receiving portion in the first transverse direction and that is opposite to said first shackle mounting portion, said second shackle mounting portion being formed with a second shackle insert hole that is aligned with said first shackle insert hole in the longitudinal direction, said second shackle mounting portion being further formed with a slide channel that extends in the first transverse direction to communicate said second shackle insert hole with said latch recess;

a key-operated lock core unit including a cylindrical lock core formed with a keyhole and disposed in said core receiving space, said lock core being adapted to be rotated inside said core receiving space upon insertion of a corresponding key into said keyhole, said lock core having one end disposed adjacent to said latch recess, and a latch member connected to said one end of said lock core and extending into said latch recess, said latch member being rotatable inside said latch recess between locking and unlocking positions when the corresponding key is operated, said latch member having and end face which is transverse to an axis of said lock core and which is formed with a pin hole that is eccentric to the axis of said lock core;

a shackle bar having a first end extending into said first shackle insert hole, and a second end extending into said second shackle insert hole, at least one of said first and second ends being removable from a corresponding one of said first and second shackle insert holes; and a catch member disposed slidably in said latch recess, said catch member having a shackle engaging end portion for engaging said shackle bar, and a latch engaging end portion opposite to said shackle engaging end portion and formed with a pin that extends rotatably into said pin hole in said latch member for engaging said latch member such that said catch member is movable between locking and unlocking positions when said latch member moves between the locking and unlocking positions, said shackle engaging end portion of said catch member extending through said slide channel and into said second shackle insert hole for engaging said shackle bar when said catch member is moved to the locking position, said shackle engaging end portion being retracted into said slide channel for disengaging from said shackle bar when said catch member is moved to the unlocking position;

said latch member having a side wall transverse to said end face, said side wall being formed with a slide slot that extends along a plane parallel to said end face, and a communicating hole that extends parallel to the axis of said lock core from said end face to said side slot, said side wall having a stop flange formed between said end face and said slide slot, said catch member being formed with a stop projection which extends through said communicating hole and into said side slot, said stop projection being slidable along said slide slot when said catch member and said latch member move between their locking and unlocking positions, said stop projection of said catch member being registered with said stop flange of said latch member so as to prevent removal of said latch member from said catch member along a direction parallel to the axis of said lock core when said latch member is disposed in the locking position, said stop projection being registered with said communicating hole so as to permit removal of said latch member from said catch member along the direction parallel to the axis of said lock core when said latch member is disposed in the unlocking position.

2. The padlock according to claim 1, wherein said catch member has two opposite side walls, each being formed with a sliding block that extends parallel to the first transverse direction.

3. The padlock according to claim 1, wherein said second end of said shackle bar extends through said second shackle insert hole, and is formed with a shackle groove for engaging said shackle engaging end portion of said catch member, said first end of said shackle bar extending removably into said first shackle insert hole, said first shackle insert hole being provided with a biasing spring for biasing said shackle bar away from said first shackle mounting portion to permit removal of said first end of said shackle bar from said first shackle insert hole when said latch member is disposed in the unlocking position, said first end of said shackle bar being provided with an abutment unit, said second shackle insert hole having an inner surface formed with a retaining shoulder which abuts against said abutment unit to prevent removal of said shackle bar from said second shackle insert hole when said shackle bar is moved away from said first shackle insert hole.

4. The padlock according to claim 3, wherein said abutment unit is a spring-loaded ball unit which projects from said shackle bar in a direction transverse to length of said shackle bar.

5. The padlock according to claim 1, further comprising a lock core retainer mounted on said first shackle mounting portion and extending in the first transverse direction into said core receiving space for engaging said lock core unit so as to prevent removal of said lock core unit from said core receiving space along the longitudinal direction.

6. The padlock according to claim 5, wherein said first shackle mounting portion is formed with a receiving cavity communicated with said core receiving space, said lock core retainer including a retaining shaft received in said receiving cavity and a biasing spring for biasing said retaining shaft to project into said core receiving space and engage said lock core unit, said first shackle mounting portion having a side wall confronting said second shackle mounting portion and formed with a through hole which is communicated with said receiving cavity, said through hole being adapted to permit extension of a tool into said receiving cavity for moving and retracting said retaining shaft into said receiving cavity when said first end of said shackle bar is removed from said first shackle insert hole.

7. The padlock according to claim 6, wherein said retaining shaft has an outer surface formed with a groove adapted to engage the tool.

* * * * *